United States Patent [19]

Hermann

[11] 4,369,085

[45] Jan. 18, 1983

[54] HAND-HELD LABELLING DEVICE

[76] Inventor: Klaus-Dieter Hermann, Ritterweg 17, D 6932 Hirschhorn, Fed. Rep. of Germany

[21] Appl. No.: 259,752

[22] Filed: May 1, 1981

[30] Foreign Application Priority Data

May 8, 1980 [DE] Fed. Rep. of Germany ..... 3017555

[51] Int. Cl.[3] ..... B65C 11/02

[52] U.S. Cl. ..... 156/384; 101/288; 101/292; 156/541; 156/577; 156/579; 156/584; 156/DIG. 49

[58] Field of Search ..... 156/384, 541, 577, 579, 156/584, DIG. 48, DIG. 49; 101/288, 292

[56] References Cited

U.S. PATENT DOCUMENTS 3,817,177 6/1974 Van Arnam et al. ..... 101/288
4,188,255 2/1980 Gottardo ..... 156/384

FOREIGN PATENT DOCUMENTS 253431 4/1967 Austria .
2646355 10/1976 Fed. Rep. of Germany .
2638441 11/1977 Fed. Rep. of Germany ..... 156/384

*Primary Examiner*—Michael G. Wityshyn
*Attorney, Agent, or Firm*—William D. Hall

[57] ABSTRACT

The present invention relates to a hand-held labelling device for printing, detaching and dispensing individual adhesive labels mounted on a backing strip and for applying such labels to articles to be labelled, the label tape being guided from a reel of label tape via a counterplate to a deflecting edge and from the latter to transport means arranged in the area below the reel of label tape and comprising a transport wheel with backstop which positively engages the backing strip and which can be moved on step by step by means of an operating handle to transport the said strip, the deflecting edge being provided between the counterplate and the forward end opposite the operating handle and mounted together with the counterplate on a swing-out bottom mounted to pivot about a stationary pin provided in the rear bottom portion, the said device comprising further a pressure roller provided in front of the deflecting edge in the forward portion of the device opposite the said pin. In order to facilitate loading of the device with the label tape, the transport means is designed as one unit and likewise fastened to the swing-out bottom, and the space in the casing between the bottom and the reel of label tape defined by the width of the labels is kept free of components of any type.

26 Claims, 5 Drawing Figures

HAND-HELD LABELLING DEVICE

Figure 1:
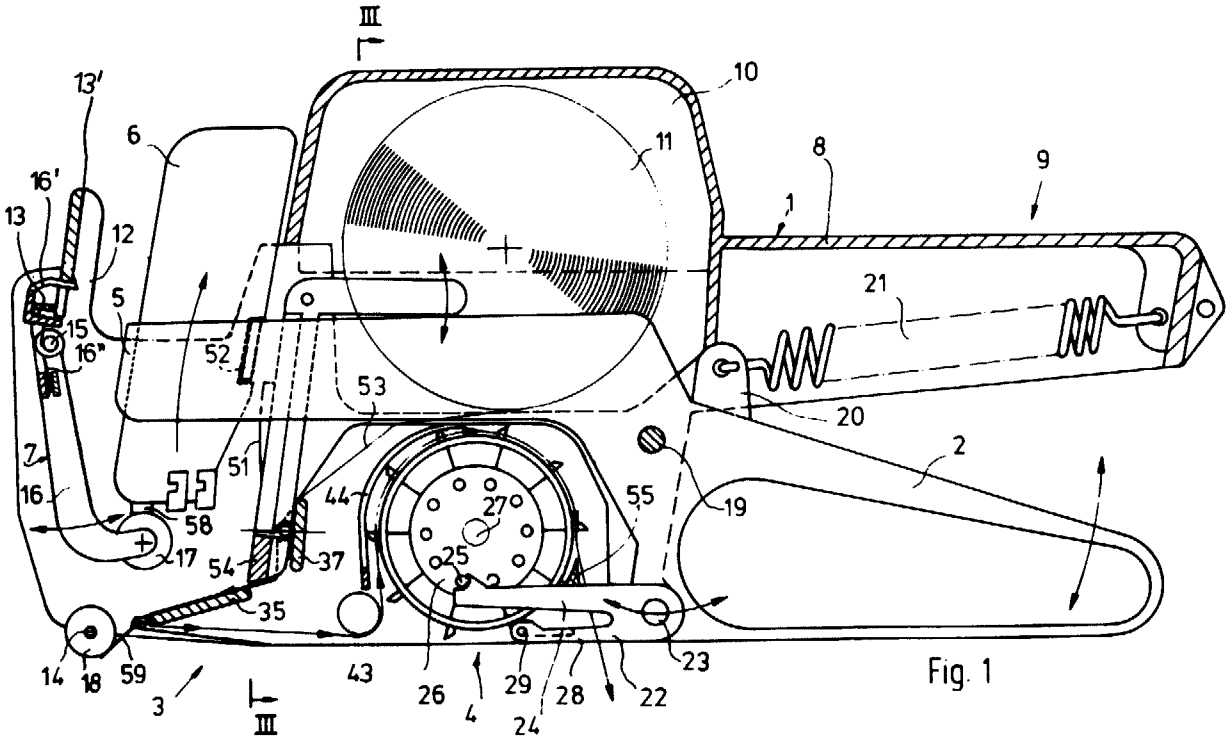

The present invention relates to a hand-held labelling device for printing, detaching and dispensing individual adhesive labels mounted on a backing strip and for applying such labels to articles to be labelled, the label tape being guided from a reel of label tape via a counterplate to a deflecting edge and from the latter to transport means arranged in the area below the reel of label tape and comprising a transport wheel with backstop which positively engages the backing strip and which can be moved on step by step by means of an operating handle to transport the said strip, the deflecting edge being provided between the counterplate and the forward end opposite the operating handle and mounted together with the counterplate on a swing-out bottom mounted to pivot about a stationary pin provided in the rear bottom portion, the said device comprising further a pressure roller provided in front of the deflecting edge in the forward portion of the device opposite the said pin.

There have been known hand-held labelling devices in the most different forms. They are used for price-marking of goods in the retail trade, in particular in supermarkets and self-service shops. Of the large number of designs known those which could prevail on the market all have the form of pincers with a rectangular casing—as viewed in side elevation—with the pressure roller provided at its forward end, one handle mounted rigidly to the opposite end of the casing and a second pivoted handle arranged near the said first rigid handle. Pivoting the operating handle against the action of a spring causes the printing unit to move towards the counterplate and to imprint a label resting thereon. The spring-actuated return movement of the operating handle causes the transport wheel of the transport means to move the backing strip on by one label pitch. At the same time, the printed label is detached from the backing strip at the deflection edge and then applied to and pressed upon the article to be labelled through the action and movement of the pressure roller. Labelling devices of this type have been known for instance from German Patent Specification No. 12 24 661 or German Disclosed Patent Application No. 19 24 023 and German Disclosed Patent Application No. 15 11 892. All the known devices consist of a great number of individual components so that they can be produced only at relatively high cost. But their main disadvantage must be seen in the fact that the loading of a new label tape after the preceding one has been fully spent requires a certain manual skill. For, to this end the label reel must be inserted from the top and the end of the label tape must be guided downwardly through the device and out of the latter on its open underside (German Disclosed Patent Application No. 19 24 023) or on the underside which has been opened by swinging out the bottom (German Disclosed Patent Application No. 14 36 047; German Disclosed Patent Application No. 15 11 892). Thereafter, the tape is guided around the deflecting edge and introduced into the transport means. In practice, it has been found that the persons handling such devices often find the loading difficult.

There has also been known a device in which the label reel is loaded from below (AT Patent Specification No. 253 431). But this device does not employ separate labels, but rather a label tape which is subsequently cut into separate labels by means of a cutter arrangement. In this device, the cutting and the transport means are accommodated in the forward area and of a rather complex design comprising a plurality of levers. A similar device employing a label tape which is to be subsequently cut into separate labels (AT Patent Specification No. 245 497) has the transport means accommodated in the rear portion near the operating lever and designed as a stepping wheel about which the backing strip of the label tape is wound. The bottom of the device can be swung out for loading the label reel from below. But the label tape must be threaded through the space between a guide roller and a counterplate and during this process it comes to bear against a cutting device so that threading in of the tape is rather difficult inspite of the swing-out bottom. Apart from the difficult loading of the label tape and the great number of components required for the device it is a common disadvantage of both devices that they have a relatively great overall length because the label reel and the transport means are arranged one behind the other. But to use a relatively long device is more tiring for the user than to use a shorter device of the same weight, and this is why the devices mentioned at the outset have the transport means and the label reel generally arranged one above the other, although this arrangement requires threading-in of the label tape which makes the introduction of the tape more difficult.

Now, it is the object of the present invention to provide a device of the type mentioned before which while rendering loading of the label simpler can be produced at low cost because it consists only of a small number of components. In other words, the invention is to provide a hand-held labelling device which is particularly simple as regards both its production and its use.

This problem is solved in a hand-held labelling device of the type mentioned before in that the transport means is designed as one unit and likewise fastened to the swing-out bottom, and the space in the casing between the bottom and the reel of label tape defined by the width of the labels is kept free of components of any type.

This design gives the surprising effect that after swinging out the bottom the reel of label tape can be loaded into the device although the reel of label tape and the transport means are arranged one above the other. Another surprising advantage of this design is to be seen in the fact that the label tape need not be threaded in because the end of the tape hanging out of the device is automatically, and without any effort on the user's part, brought into its correct position by the counterplate provided on the swing-out bottom and the deflecting edge. It suffices to introduce the free end of the tape into the transport means after the bottom has been closed. Still another advantage must be seen in this connection in the simplified design of the device which makes it particularly easy to service in that in the case of possible repairs to the transport means, the latter may be exchanged together with the bottom as one complete unit without the need to dismantle the whole device, a need which cannot be avoided in the case of the conventional devices.

The transport means always include a backstop which keeps the tape in the correct position between the feed steps. Usually, the backstop consists of a leaf spring or pawl mounted on the casing of the device and engaging corresponding recesses or projections of the transport wheel. In preferred embodiments of the invention, however, the backstop is not mounted on the casing, but part of the transport unit and swings out together with the bottom. This offers the advantage that possible assembly or production inaccuracies do not impair the function of the backstop. Besides, the function of the backstop can be checked also with the bottom swung out.

In the known devices, the casings mostly consist of two plate-shaped elements kept in spaced parallel relationship by means of shafts, spacer pins, and the like, the different components such as counterplate, transport means, pressure roller, etc. being arranged between these plates and screwed or riveted thereto. However, the considerable assembly times needed in this case increase not only the cost of production, but also the cost of repair and maintenance work. In a preferred embodiment of the invention, in contrast, the casing consists of one single part of U-shaped cross-section. This design has become possible due to the fact that no essential elements have to be mounted within the device considering that the printing unit swings out together with the bottom. The only elements mounted at the casing are the pivot axis for the operating handle which is located near the outer edge of the casing, and the shaft of the pressure roller which is likewise located close to the outer edge of the casing. However, shafts mounted close to the outer edge of the casing can be easily mounted because it suffices in this case to spread the housing slightly to slip the corresponding shafts into place. It results, that the arrangement of the transport means as one unit on the swing-out bottom permits still further surprising advantageous improvements. Apart from the arrangement described before, it makes it possible for example to give the top of the casing in the area of the reel of label tape a closed shape and to form the reel holder as an integral part of the casing. For, the reel holder consists in this case only of the—anyway existing—sidewalls of the casing and a top cover of the casing. The bottom of the space accommodating the reel of label tape is defined by guide bars extending above the transport wheel and formed as integral parts of the bottom part of the housing.

Although the transport means swings out together with the bottom, the driving action can be simply and reliably transmitted from the operating handle to the transport wheel. To this end, one embodiment of the invention is provided with a driving pawl which is pivoted on the operating handle and urged by the action of a spring against the transport wheel. Preferably, the driving pawl when viewed from the side has substantially the shape of a U with the pivot axis located in the area of the crossbar, one leg bearing against the transport wheel and the other leg bearing against the bottom. Further, the driving pawl is made from a plastic material, and the said other leg is supported by the bottom in a manner such that the driving pawl is relaxed when the device is in its rest position. Thus, although consisting of a plastic material the driving pawl will not deteriorate in the course of time as regards its resilient properties because its action is limited to very short periods of time, namely the duration of the working stroke. Finally, the pivot axis of the driving pawl is at least approximately aligned with the pivot axis of the bottom when the device is in its rest position. This offers the advantage that inspite of the driving connection of the transport means and the operating handle through the driving pawl, the bottom can be swung out fully and without any obstruction.

Preferably, the bottom does not take the form of a continuous plate closing the full underside of the device. Rather, it is provided with an opening in the area of the transport means and comprises essentially two parallel plates arranged in parallel to the sidewalls of the casing and including between them the transport means. These plates carry the shaft of the transport wheel, and at least one of these plates has a recess formed therein with a resilient tongue formed as an integral part thereof and serving as a backstop. The resilient tongue coacts with a corresponding toothing provided on the face of the transport wheel.

In order to improve the above-mentioned introduction of the free end of the tape when the bottom is pivoted into position and to make sure that the tape takes the desired path, a preferred embodiment of the invention is equipped with a guide plate arranged at the bottom at an angle of approximately 120° relative to the counterplate, near the end of the counterplate opposite the deflecting edge. This guide plate causes the tape to move along a guide flange fixed in the casing in the neighbourhood of the guide plate.

In one preferred embodiment of the invention, the bottom, the plates, the counterplate, the deflecting edge, the guide plate and the backstop are formed in one piece from a plastic material. The design as one piece simplifies both the assembly and maintenance of the device, the production from a plastic material reduces the cost of production.

The closed rest position of the bottom can be secured in different manners. In one preferred embodiment of the invention, retention hooks are provided for this purpose at the bottom near the upper end of the guide plate. In the closed condition of the device, these retention hooks engage a crossbolt which is slidably guided in the casing and which in the closed condition of the device occupies a position directly in front of and parallel to the guide plate. This crossbolt which extends outwardly beyond the casing of the device and which has its outer ends equipped with one knob each can be displaced to unlock the bottom.

Some of the known devices are equipped with a tape brake for clamping at least in the rest position of the device the label tape between the reel of label tape and the deflecting edge. In the simplest of all cases, this brake consists of a leaf spring acting against the surface of the reel of label tape (AT Patent Specification No. 245 497). However, it is a disadvantage of this arrangement that it increases the force required for operating the device, and therefore preference is given to tape brakes which are inoperative as long as the device is being operated. Accordingly, one preferred embodiment of the invention has the brake formed by a toggle lever which is pivoted in the housing and which in the rest position has its one arm bearing against the extension of the operating handle carrying the printing unit, and its other arm pressed against the guide plate. In this manner, a self-releasing brake has been provided because during operation of the device the extension of the operating handle moves away from the first arm of the toggle lever so that as a result thereof its other arm does no longer press the tape against the guide plate, i.e. clamp it in position.

However, this embodiment of the tape brake may be used with advantage also for another function, as has been done in one preferred embodiment of the invention. In this latter embodiment, a cam is formed on the other arm of the toggle lever in substantially concentrical relation to the axis of the operating handle, and a crossbar is integrally formed on the extension of the operating handle at a distance from the axis of the operating handle which is slightly larger than the radius of the said cam. Further, the cam is provided with a recessed portion in the area where the crossbar comes to lie in the rest position of the operating handle. This arrangement of the cam and the crossbar ensures that the crossbolt which is seated in oblong holes provided in the sidewalls of the casing in the area of the lower end of the arm of the toggle lever, can be moved only in the rest position of the operating handle when the crossbar occupies the position opposite the recess. However, when the operating handle is actuated the crossbar occupies the position opposite the cam so that the toggle lever cannot be pivoted beyond the position in which the braking action is just released. This ensures that the crossbolt is locked when the operating handle is operated so that the hook formed on the bottom cannot be disengaged and the bottom cannot swing out.

Figure 2:
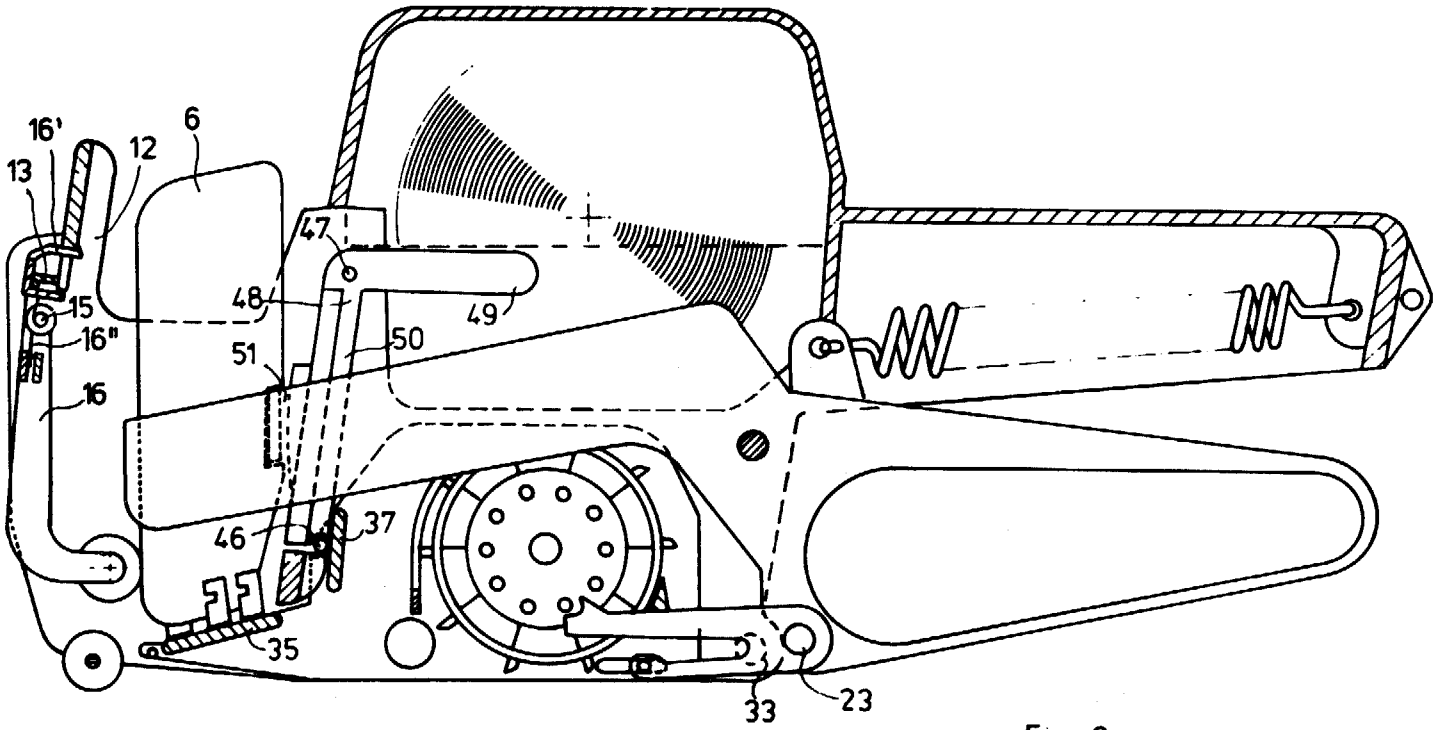
Figure 3:
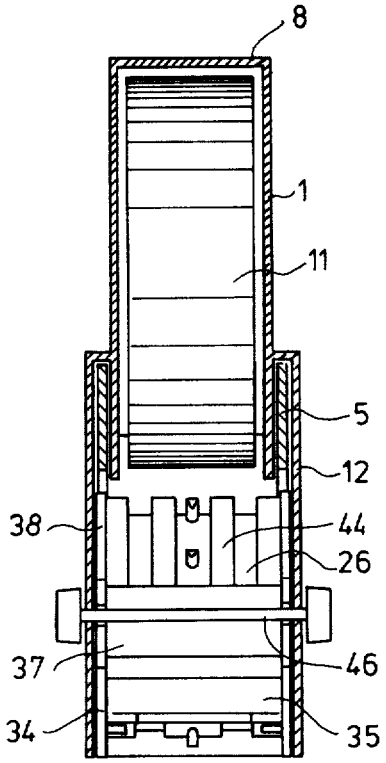
Figure 4:
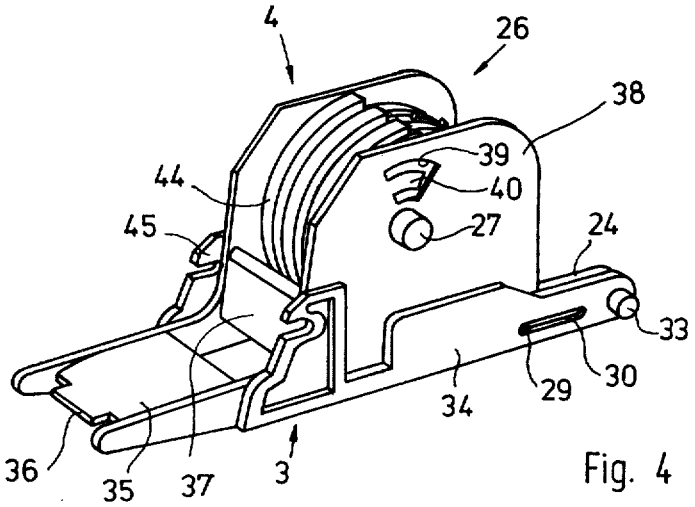
Figure 5:
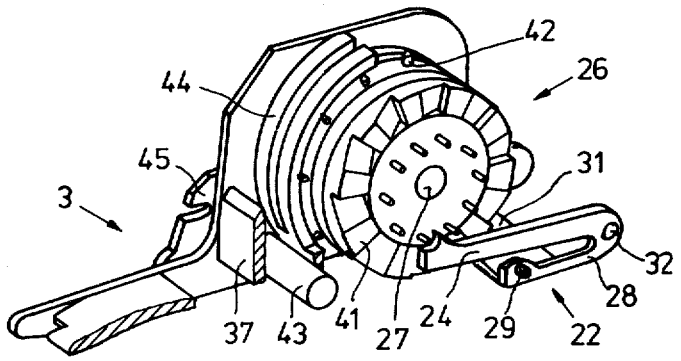

Other details and improvements of the present invention will be apparent from the claims and the following description of one embodiment of the invention illustrated by way of example in the simplified and diagrammatic drawing in which:

FIG. 1 shows a longitudinal section along the inside of the sidewall facing the viewer, with the components in the rest position;

FIG. 2 the arrangement shown in FIG. 1, with the components in the operative position;

FIG. 3 a section along line III—III in FIG. 1;

FIG. 4 a perspective view of the swing-out bottom, including the transport means; and FIG. 5 a perspective view of the arrangement of FIG. 4, with the forward carrying plate broken away.

The devices shown in the drawing consist substantially of four partly integrally formed elements, namely a casing 1 formed in one piece, an operating handle 2 likewise formed in one piece, a bottom 3 pivoted on the casing 1 with transport means 4 mounted thereon, and a printing unit 6 fitted upon an extension 5 of the operating handle 2 with inking means 7 pivotally mounted at the casing.

The casing is preferably die cast in one piece from a plastic material and comprises two plates which extend in parallel to the plane of the drawing and which are interconnected by crosswalls 8 shown in dashed lines in FIGS. 1 and 2. The outlines of the two parallel plates can likewise be seen in FIGS. 1 and 2. The crosswalls 8 in the area of a handle 9 rigidly formed on the housing 1 and a chamber 10 serving to accommodate the reel of label tape 11 define together with the lateral plates a casing of U-shaped cross-section. In the forward portion, the side plates 12 of the casing 1 are not connected by crosswalls, but rather by a crossbar 13 of rectangular cross-section and a wall portion 13' in the upper area, and a shaft 14 in the lower area. The crossbar 13 serves to receive the inking means 7 which is detachably fitted on journal pins 15 provided on a retaining clip 16' which in turn is mounted and fixed in position on the crossbar 13. The pin 15 serves as journal for a holder 16 for an inking roller of the inking device. The free end of the said holder 16 carries an inking roller 17 which is urged into contact with the printing types 58 of the printing unit 6 by means of a leg spring which is wound about the journal pins 15 and which has its one leg bearing against the holder 16 and its other leg bearing against the holding clip 16'. The holding clip 16' and the holder 16 with the inking roller 17 can be mounted on and removed from the crossbar 13 as one unit (inking means 7). The shaft 14 carries a rotating pressure roller 18. A printed label 59 which is largely detached from the carrier strip is placed in the known manner between the said pressure roller ready for being dispensed.

The operating handle 2 is mounted to pivot about an axis 19 disposed near the root of the handle 9. A projection 20 is integrally formed on the operating handle 2 near the axis 19. This projection 20 is engaged by a return spring 21 which takes the form of a spiral tension spring and which has its other end connected to the end of the rigid handle 9. The two extensions 5 extend in the form of flat plates directly adjacent to the side plates 12 within the casing right to the printing unit 6 which is fitted thereon. In the rear area of the bottom, a driving pawl 22 of U-shaped cross-section is mounted to pivot about an axis 23 arranged at the lower end of the handle portion of the operating handle 2. The driving pawl 22 is designed as a U-shaped spring and made from a plastic material. The end of its upper rigid leg 24 has the configuration of a fork which coacts with an axially projecting pin 25 of a transport wheel 26 which can rotate about an axis 27. The other, lower leg 28 of the driving pawl 22 is guided in an oblong hole 30 in the bottom 3 by means of a pin 29. It goes without saying that the driving pawl 22 can be provided at desire on one, but preferably on both sides of the transport wheel 26. In the latter case, the two driving pawls are interconnected in the area of the pin 29 by a crossbar 31. The axis 23 is formed by a pin projecting outwardly from the handle portion of the operating handle 2 and engaging a bore 32 in the driving pawl 22.

The bottom 3 and the transport means 4 can be jointly pivoted about an axis 33 which is fixed to the casing and which in the rest position of the operating handle 2 shown in FIG. 1 is substantially aligned with the axis 23. As can be seen in FIG. 4, the axis 33 takes the form of an outwardly projecting pin engaging a corresponding bore in the side plate of the casing 1. The bottom shown in FIGS. 4 and 5 consists of two longitudinal plates 34 spaced at a distance which allows them to be pivoted into the casing 1. The two longitudinal plates 34 are interconnected by a counterplate 35 disposed in the end portion facing away from the axis 33 and provided on its forward end with a deflecting edge 36 for the label tape. A guide plate 37 connecting the two longitudinal plates 34 is arranged at a certain distance from the rear end of the counterplate 35 opposite the deflecting edge 36. An upwardly projecting portion of the longitudinal plates 34 forms the carrying plates 38 carrying the axis 27 for the transport wheel 26. At least one of the two carrying plates 38 is provided with an opening 39 with a tongue 40 projecting from the edge of the said opening. This tongue 40 serves as a resilient backstop, its free end being in resilient engagement with a toothing 41 provided on the face of the transport wheel 26. The transport wheel 26 is conventionally equipped with pins 42 projecting radially from its periphery. These pins coact with recesses in the backing strip to positively entrain the latter.

Between the guide plate 37 and the transport wheel 26, there is provided another guide roller 43. Further there are provided in this area guide bars 44 extending in parallel relative to each other and at a certain distance to the generated surface of the transport wheel 26.

Finally, the longitudinal plates 34 are equipped with integrally formed retention hooks 45 which engage a crossbolt 46 when the bottom 3 is pivoted into the casing 1. The crossbolt 46 is guided and held in an oblong hole extending in parallel to the bottom in the side plates 12 of the casing 1.

A brake taking the form of a toggle lever 48 is seated on an axis 47 in the middle of the upper portion of the casing 1. In the rest position of the operating handle 2, the one arm 49 of the said toggle lever bears against the upper face of the extensions 5, while the other arm 50 extends downwardly right to the crossbolt 46 for which a recess is formed in the arm 50. The return spring 21 urges each of the extensions 5 against one of the arms 49 (on the two sidewalls of the casing) and, thus, the end of the arm 50 against the guide plate 37.

A cam 51 ending at a certain distance from the axis 47 is formed in concentrical relation to the axis 19 on the other side of the arm 50 facing away from the guide plate 37. A crossbar 52 connects the two extensions 5 of the operating handle 2, the distance between the said crossbar and the axis 19 being slightly greater than the distance between the surface of the cam 51 and the axis 19. Now, when the operating handle is moved out of its rest position as shown in FIG. 1, the crossbar 52 is moved into a position opposite the cam 51 in which the swinging motion of the arm 50 is limited by the contact between the cam 51 and the crossbar 52. So, the crossbolt 46 also cannot be displaced in its oblong hole far enough to permit the retention hooks 45 to be released.

To put the device into operation, one displaces the crossbolt 46 in its oblong hole, with the operating handle 2 in the rest position, until the retention hooks 45 are no longer engaged. Then one swings the bottom portion 3 about the axis 33 into the open position and positions a reel of label tape 11 in the chamber 10 introducing it from below with the end of the backing strip 53 carrying the labels 59 projecting outwardly. Now, when the bottom 3 is moved into position, the guide plate 37 and the counterplate 35 press the tape against a deflecting web 54 fixed in the casing 1 to connect the two side plates 12 of the casing 1 immediately beneath the oblong hole carrying the crossbolt 46. Now, the end of the backing strip 53 projects outwardly from below the pressure roller 18. One grips this outwardly projecting end and introduces it into the transport means 4 between the guide roller 43 and the transport wheel 26. When the operating handle and, thus, the transport wheel is thereafter operated the backing strip is automatically fed along its correct path, supported by the guide bars 44. The backing strip works its way out of the casing through the space between the two driving pawls 22, a bar 55 of triangular cross-section serving to detach the strip from the transport wheel. The ends of the bar 45 are fastened to the carrying plates 38.

For dispensing a label, one holds the device by the handle 9 and moves the operating handle 2 inwardly. As a result thereof, the previously existing braking effect caused by the pressure exerted by the arm 50 upon the guide plate 37 is released and the printing unit 6, after having first moved the inking device 7 outwardly is pressed with its inked types 58 upon the label positioned on the counterplate 35 to imprint the label. Simultaneously therewith, the driving pawl 22 has been retracted giving way to the next pin 25. Now, when the operating handle 2 is released, it is returned to its rest position by the action of the previously tensioned return spring 21. As a result thereof, the driving pawl 22 is moved forward and acts upon the pin 25 to feed the transport wheel 26 on by one further step. This advances the backing strip 53 and draws a corresponding length of tape off the reel 11. Simultaneously therewith, a label 59 is detached from the backing strip at the deflecting edge and positioned below the pressure roller 18. By pressing the pressure roller 18 against an article to be labelled and withdrawing the device thereafter the label 59 is fully detached from the strip and rolled upon the article.

It goes without saying that the invention is not limited to the embodiment described by way of example but that variations can be applied without deviating from the scope of the invention. In particular, the individual features of the invention may be employed either individually or in any desired combination.

I claim:

1. A hand-held labelling device for printing, and dispensing individual adhesive labels mounted on a backing strip and for applying such labels to articles to be labelled, and labels tape being guided from a reel of label tape via a counterplate to a deflecting edge and from the latter to transport means arranged in the area below the reel to label tape and comprising a transport wheel with backstop which positively engages the backing strip and which can be moved on step by step by means of an operating handle to transport the said strip, the deflecting edge being provided between the counterplate and the forward end opposite the operating handle and mounted together with the counterplate on a swing-out bottom mounted to pivot about a stationary pin provided in the rear bottom portion, the said device comprising further a pressure roller provided in front of the deflecting edge in the forward portion of the device opposite the said pin, characterized in that the transport means is designed as one unit and likewise fastened to the swing-out bottom, that the space in the casing between the bottom and the reel of label tape defined by the width of the labels is kept free of components of any type, and that the reel of label tape may be put loosely into the casing through the aperture opened by the swing-out bottom in its swung-away position.

2. A hand-held labelling device in accordance with claim 1, characterized in that the backstop is part of the unit and likewise mounted to swing out with the bottom.

3. A hand-held labelling device in accordance with claim 1, characterized in that the casing consists of a plastic part of U-shaped cross-section.

4. A hand-held labelling device in accordance with claim 3, comprising an exchangeable, adjustable printing unit that can be moved from the top against the counterplate, and an inking roller for inking the printing types pivotally mounted for each exchange in the forward area of the chasing, characterized in that a crossbar of non-circular cross-section is formed on the casing, that a retaining clip is non-rotatably mounted and fixed on the crossbar, that the retaining clip is provided with journal pins for mounting a holder for the inking roller, and that a spring which bears with its one end against the retaining clip and with its other end against the holder for the inking roller tends to urge the holder for the inking roller into an end position near the printing unit.

5. A hand-held labelling device in accordance with claim 3, characterized in that the casing is closed at the top in the area of the reel of label tape.

6. A hand-held labelling device in accordance with claim 5, comprising an exchangeable, adjustable printing unit that can be moved from the top against the counterplate, and an inking roller for inking the printing types pivotally mounted for easy exchange in the forward area of the casing, characterized in that a crossbar of non-circular cross-section is formed on the casing, that a retaining clip is non-rotatably mounted and fixed on the crossbar, that a retaining clip is provided with journal pins for mounting a holder for the inking roller, and that a spring which bears with its one end against the retaining clip and with its other end against the holder for the inking roller tends to urge the holder for the inking roller into an end position near the printing unit.

7. A hand-held labelling device in accordance with claim 1, characterized in that a driving pawl is provided to drive the transport wheel and that the said driving pawl is pivoted at the operating handle and urged under the action of a spring against the transport wheel.

8. A hand-held labelling device in accordance with claim 7, characterized in that the driving pawl is substantially U-shaped in side elevation and has its pivot point arranged in the crossbar area and one leg bearing against the transport wheel and the other leg bearing against the bottom.

9. A hand-held labelling device in accordance with claim 8, characterized in that in the driving pawl is made from a plastic material and that the said other leg is resilient and positioned relative to the bottom in a manner such that it is relaxed when the device is in its rest position.

10. A hand-held labelling device in accordance with claim 7, 8, or 9, characterized in that in the rest position the pivot axis of the driving pawl is at least approximately aligned with the pivot axis of the bottom.

11. A hand-held labelling device in accordance with claim 1, characterized in that the transport unit comprises two plates carrying the shaft of the transport wheel and that a recess with a resilient tongue acting as a backstop integrally formed therein is worked into the said plates.

12. A hand-held labelling device in accordance with claim 1 or 11, characterized in that the bottom together with the transport means is fastened interchangeably to the casing.

13. A hand-held labelling device in accordance with claim 1, characterized in that a guide plate is provided on the bottom near the end of the counterplate opposite the deflecting edge and that the said guide plate is inclined relative to the counterplate at an angle of substantially 120°.

14. A hand-held labelling device in accordance with claim 1, characterized in that the bottom, the longitudinal plates, the carrying plates, the counterplates, the deflecting edge, the guide plate, and the backstop are formed as one part from a plastic material.

15. A hand-held labelling device in accordance with claim 13 or 14, characterized in that retention hooks are integrally formed at the bottom near the upper end of the guide plate, and that in the closed condition of the device the said retention hooks engage a crossbolt which is slidably mounted in the casing and which in the closed condition of the device extends directly in front of and parallel to the guide plate from one side plate to the other side plate of the casing.

16. A hand-held labelling device in accordance with claim 1, comprising a hand brake which in the rest position of the device clamps the label tape between the label tape reel and the deflecting edge, characterized in that the brake takes the form of a toggle lever mounted to pivot in the casing and having in the rest position its one arm bearing against an extension to the operating handle which carries the printing unit, and its other arm pressed against the guide plate.

17. A hand-held labelling device in accordance with claim 16, characterized in that a cam is formed on the said other arm of the toggle lever substantially concentrically to the axis of the operating handle, that a crossbar is formed on the extension of the operating handle at a distance from the axis slightly greater than the radius of the cam, and that the cam exhibits a recessed portion in the area where the crossbar comes to lie in the rest position of the operating handle.

18. A hand-held labelling device in accordance with claim 1 or 2, comprising an exchangeable, adjustable printing unit that can be moved from the top against the counter plate, and an inking roller for inking the printing types pivotally mounted for easy exchange in the forward area of the casing, characterized in that a crossbar of non-circular cross-section is formed on the casing, that a retaining clip is non-rotatably mounted and fixed on the crossbar, that the retaining clip is provided with journal pins for mounting a holder for the inking roller, and that a spring which bears with its one end against the retaining clip and with its other end against the holder for the inking roller tends to urge the holder for the inking roller into an end position near the printing unit.

19. A hand-held labelling device for printing, detaching, and dispensing from a reel individual adhesive labels mounted on a backing strip and for applying such labels to articles to be labelled, the device comprising:

a housing which defines a chamber and an aperture at the lower portion of the chamber, the housing being dimensioned to contain a reel of label tape within the chamber defined thereby;

a bottom portion;

transport means for incrementally drawing label tape from a reel when contained in the housing;

means for guiding the tape from such reel contained in the housing onto the transport means;

means for detaching a label from the backing strip each time the label tape is incrementally drawn by the transport means;

the detaching means being disposed between the reel and the transport means at the forward portion of the device and the transport means, guiding means, and detaching means each being mounted onto the bottom portion; and pin means for pivotally connecting the bottom portion to the housing, the pin means being disposed toward the rear portion of the device, thereby permitting the front section of the bottom portion to move relative to the housing;

wherein the forward section of the bottom portion is selectively movable about the pin means to (a) a first position in which the front section of the bottom portion swings away from the housing thereby exposing the aperture at the lower portion of the housing to permit a reel of label tape to be inserted therein or removed therefrom, or (b) a second position in which the bottom portion closes the aperture at the lower portion of the housing such that a reel of label tape inserted through the aperture into the chamber is loosely contained within the chamber.

20. A device according to claim 19 further comprising:

a rotatable pressure roller pivotally coupled to the housing at the forward portion of the device, the roller being disposed proximate to the detaching means such that a label as it is detached from the backing strip is projected against the roller which, by rotating against the article with the label disposed therebetween dispenses the label onto the article.

21. A device according to claim 19 wherein the pin means is selectively removable, thereby permitting one bottom portion to which is mounted a corresponding transport means, guiding means, and detaching means to be interchangeable with another bottom portion having a corresponding transport means, guiding means, and detaching means mounted thereto, each such bottom portion being connectable to the housing by the pin means.

22. A device according to claim 19 wherein the transport means comprises:

a transport wheel having (a) means for positively engaging the label tape, the engaging means being disposed along the periphery of the transport wheel and (b) axially projecting angularly spaced pins, each pin being disposed at a radial distance from the center of the transport wheel; and a reciprocating driving pawl which, during each reciprocating movement, engages one projecting pin after another, thereby rotating the transport wheel.

23. A device according to claim 19 further comprising:

means for applying print to one label after another as the transport means incrementally draws the label tape from the reel, the print applying means being disposed between the reel and the detaching means.

24. A device according to claim 23 wherein the transport means comprises:

a transport wheel having (a) means for positively engaging the label tape, the engaging means being disposed along the periphery of the transport wheel and (b) axially projecting angularly spaced pins, each pin being disposed at a radial distance from the center of the transport wheel; and a reciprocating driving pawl which, during each reciprocating movement, engages one projecting pin after another, thereby rotating the transport wheel.

25. A device according to claim 24 further comprising:

means for mechanically coupling the print applying means and the reciprocating pawl such that (a) during one half cycle of operation the reciprocating pawl is retracted from the transport wheel and the print applying means is brought into contact with a label and (b) during the second half cycle of operation the reciprocating pawl is advanced to engage a pin of the transport wheel and the print applying means withdraws from the label to which print was applied.

26. A device according to claim 25 wherein the coupling means comprises a spring-loaded operating handle.

* * * * *